US007090330B2

(12) United States Patent
Murakami et al.

(10) Patent No.: US 7,090,330 B2
(45) Date of Patent: Aug. 15, 2006

(54) LIQUID DISCHARGE APPARATUS, PRINTER HEAD, AND METHOD FOR MAKING LIQUID DISCHARGE APPARATUS

(75) Inventors: Takaaki Murakami, Kanagawa (JP); Minoru Kohno, Tokyo (JP); Koichi Igarashi, Kanagawa (JP); Shogo Ono, Kanagawa (JP); Toru Tanikawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/153,026

(22) Filed: Jun. 14, 2005

(65) Prior Publication Data

US 2005/0253896 A1 Nov. 17, 2005

Related U.S. Application Data

(63) Continuation of application No. 10/417,953, filed on Apr. 17, 2003, now Pat. No. 7,004,561.

(30) Foreign Application Priority Data

Apr. 19, 2002 (JP) ..... 2002-117188

(51) Int. Cl.
*B41J 2/145* (2006.01)
*B41J 2/15* (2006.01)

(52) U.S. Cl. ..... 347/40; 347/71

(58) Field of Classification Search ..... None
See application file for complete search history.

(56) References Cited

U.S. PATENT DOCUMENTS 5,477,247 A * 12/1995 Kanegae ..... 347/20
5,736,998 A 4/1998 Caren et al.
6,076,912 A 6/2000 Murthy
6,334,661 B1 1/2002 Steinfield et al.

* cited by examiner

*Primary Examiner*—Thinh Nguyen
(74) *Attorney, Agent, or Firm*—Robert J. Depke; Trexler, Bushnell, Giangiori, Blackstone & Marr, Ltd.

(57) ABSTRACT

A liquid discharge apparatus has liquid chambers and nozzles that discharge droplets of liquids contained in the liquid chambers through liquid channels. The liquid discharge apparatus includes a substrate provided with partitions on one face thereof, the liquid chambers and the liquid channels being defined between the partitions. The liquid discharge apparatus further includes a nozzle sheet provided with adhesion-improving layers at least at positions corresponding to the top faces of the partitions and the nozzles for discharging liquid, the nozzle sheet and the top faces of the respective partitions being bonded to each other with the adhesion-improving layers. The liquid discharge apparatus also includes driving elements provided on the face of the substrate at positions corresponding to the liquid chambers, for changing the pressure of the liquid chambers. The liquid discharge apparatus is used as a printer head for ink jet printing.

3 Claims, 6 Drawing Sheets

LIQUID DISCHARGE APPARATUS, PRINTER HEAD, AND METHOD FOR MAKING LIQUID DISCHARGE APPARATUS

The subject matter of application Ser. No. 10/417,953 is incorporated herein by reference. The present application is a continuation of U.S. application Ser. No. 10/417,953, filed Apr. 17, 2003 now U.S. Pat. No. 7,004,561, which claims priority to Japanese Patent Application NoJP2002-117188, filed Apr. 19, 2002. The present application claims priority to this previously filed application.

BACKGROUND OF THE INVENTION

1. Field of the Invention

The present invention relates to a liquid discharge apparatus, a printer head, and a method for making the liquid discharge apparatus. The liquid discharge apparatus is applicable to, for example, ink jet printers.

2. Description of the Related Art

A conventional ink jet printer discharges ink droplets through a printer head toward an object such as paper for forming a required-image on the object. The printer head discharges the droplets of the ink contained in a liquid chamber through nozzles by a driving element that causes a change in pressure in the liquid chamber. Examples of known driving elements are heating elements and piezoelectric elements.

Such a printer head is fabricated as follows, for example. A driving element integrated with a drive circuit for driving the driving element is formed on a semiconductor substrate by a semiconductor production process, and a photosensitive resin is applied thereon by spin coating. Partition walls of liquid chambers and liquid channels are formed by photolithography of the photosensitive resin. A sheet provided with nozzles (hereinafter referred to as "nozzle sheet") is formed by electrotyping and is disposed on the substrate.

In this process, the photosensitive resin is maintained at a semicured state. This nozzle sheet is bonded to the top faces of the partitions of the liquid chambers and the liquid channels, and the semicured photosensitive resin is cured by heat for thermocompression bonding of the nozzle sheet. In the present invention, thermocompression bonding from such a semicured state is referred to as "secondary bonding".

In the secondary bonding, the nozzle sheet must be bonded to the semicured resin. Since the semicured resin contains a reduced number of reactive groups, the bonding strength between the nozzle sheet and the top faces of the partitions is insufficient.

When nickel, which is a typical electrotyping material, is used as a material for the nozzle sheet, the nickel nozzle sheet having poor adhesiveness to resin does not satisfactorily adhere to the top faces of the resin partitions.

In the printer head, ink droplets are discharged from the ink chamber by a change in pressure in the ink chamber as described above. If the nozzle sheet is not sufficiently bonded to the top faces of the partitions, such a change in pressure will cause separation of the nozzle sheet from the partitions. The separation of a nozzle sheet results in undesirable vibration of the nozzle face and of meniscus of other nozzles that do not discharge ink. As a result, this poor adhesion of the nozzle sheet significantly deteriorates the quality of the printed image.

If the bonding strength is extremely low, the shape of the nozzle sheet changes with time, and ink penetrates between the nozzle sheet and the substrate. This penetrated ink damages electrical connections and causes separation of the nozzle sheet in a severe state.

SUMMARY OF THE INVENTION

An object of the present invention is to provide a liquid discharge apparatus including a nozzle sheet that is bonded to top faces of partitions with sufficiently high strength.

Another object of the present invention is to provide a printer head including such a nozzle sheet.

Another object of the present invention is to provide a method for making a liquid discharge apparatus.

According to a first aspect of the present invention, in a liquid discharge apparatus having liquid chambers and nozzles that discharge droplets of liquids contained in the liquid chambers through liquid channels, the liquid discharge apparatus comprises a substrate provided with partitions on one face thereof, the liquid chambers and the liquid channels being defined between the partitions; a nozzle sheet provided with adhesion-improving layers at least at positions corresponding to the top faces of the partitions and the nozzles for discharging liquid, the nozzle sheet and the top faces of the respective partitions being bonded to each other with the adhesion-improving layers; and driving elements provided on the face of the substrate at positions corresponding to the liquid chambers, for changing the pressure of the liquid chambers.

According to a second aspect of the present invention, in a printer head having liquid chambers and nozzles that discharge droplets of liquids contained in the liquid chambers through liquid channels, the printer head comprises a substrate provided with partitions on one face thereof, the liquid chambers and the liquid channels being defined between the partitions; a nozzle sheet provided with adhesion-improving layers at positions corresponding to the top faces of the partitions and the nozzles for discharging liquid, the nozzle sheet and the top faces of the respective partitions being bonded to each other with the adhesion-improving layers; and driving elements provided on the face of the substrate at positions corresponding to the liquid chambers, for changing the pressure of the liquid chambers.

According to a third aspect of the present invention, in a method for making a liquid discharge apparatus for discharging droplets of liquid from liquid chambers by means of a change in pressure of the liquid chambers using respective driving elements, the method comprises the steps of: forming partitions of liquid channels for introducing the liquid to the liquid chambers and partitions of the liquid chambers onto a substrate that hold the driving elements; and then placing a nozzle sheet having nozzles and adhesion-improving layers on the top faces of the partitions, the adhesion-improving layer being provided at least at positions corresponding to the top faces for improving adhesiveness to the top faces.

In the present invention, the liquid discharge apparatus of the present invention is applied to a printer head of a printer for discharging ink droplets. Furthermore, the liquid discharge apparatus is applicable to printer heads that discharges dye droplets and droplets for protective films, microdispensers for discharging chemical reagents, various analytical or testing instruments, and various patterning apparatuses that discharge chemical reagents for protecting elements from etching.

The adhesion-improving layers, provided between the top faces of the partitions and the nozzle sheet, ensure tight adhesion between them, even if the nozzle sheet exhibits low adhesiveness to the partitions. For the partitions composed of a semicured material, an appropriate material is selected for the adhesion-improving layers. For example, the partitions and the adhesion-improving layers are formed of the same material. Alternatively, the adhesion-improving layers are formed of a material having high affinity to the material of the partitions. Thus, the adhesion-improving layers ensure high bonding strength between the partitions and the nozzle sheet.

DESCRIPTION OF THE PREFERRED EMBODIMENTS

The preferred embodiments of the present invention will now be described in detail with reference to the drawings.

(1) First Embodiment

(1-1) Structure of Printer Head of First Embodiment

Figure 1:
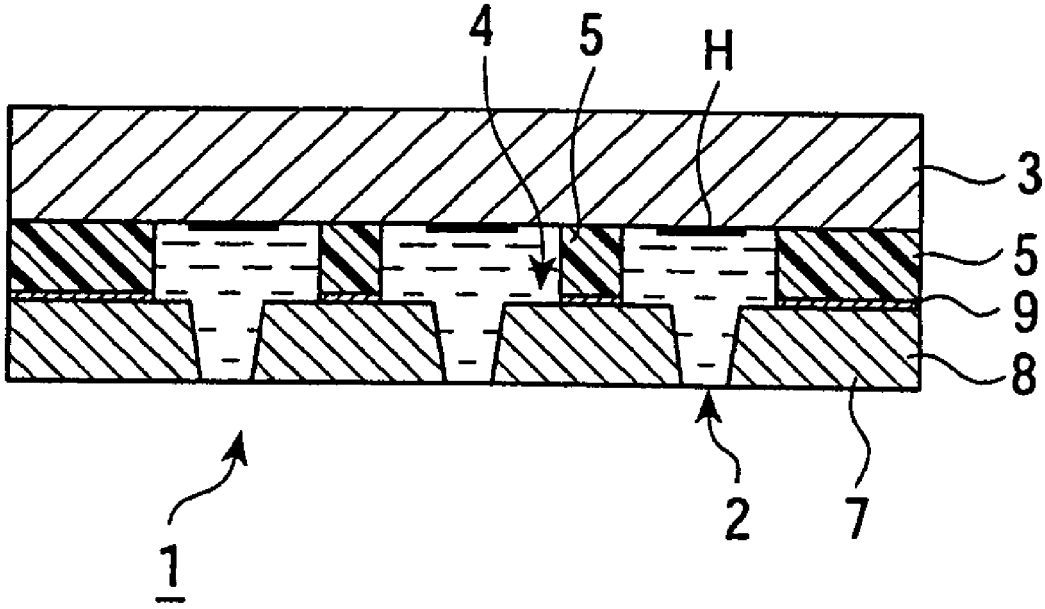
FIG. 1 is a cross-sectional view of a printer head according to a first embodiment of the present invention.

FIG. 1 is a cross-sectional view of a printer head of a printer according to a first embodiment of the present invention. The printer head 1 discharges ink droplets toward an object for printing an image and the like on the object.

This printer head 1 is a line printer head provided with a plurality of nozzle lines each having nozzles 2 across the width of a printing sheet. These nozzle lines are arranged in a paper-feeding direction-(perpendicular to the drawing), and each nozzle line discharges different color inks. The printer head 1 can thereby print color images.

This printer head 1 is prepared by forming partitions 5 of liquid chambers 4 for containing inks and partitions of liquid channels for introducing the inks to the liquid chambers 4 on a substrate 3, and bonding a nozzle sheet unit 7 to the partitions 5.

The substrate 3 is composed of a semiconductor wafer, heating elements H functioning as driving elements for changing the pressure in the liquid chambers 4, and a drive circuit for driving the heating elements H. The wafer, the heating elements H, and the drive circuit are integrated by a semiconductor production process. The semiconductor wafer is cut into a predetermined shape. In this printer head 1, the heating elements H change the pressures of the liquid chambers 4 to discharge the inks contained in the liquid chambers 4 as droplets toward a printing object.

The partitions 5 are formed of an epoxyacrylate photoresist. After the photoresist is applied onto the substrate 3 into a predetermined thickness by any coating process, for example, spin coating or curtain coating, and is prebaked. Alternatively, a photosensitive resin dry film is laminated to the substrate 3. The photoresist or the dry film is exposed through a photomask and is developed. In this process, the nozzle sheet unit 7 is arranged in a semicured state and then is completely cured.

The nozzle sheet unit 7 is prepared by forming adhesion-improving layers 9 on a nickel nozzle sheet 8, which is produced by electrotyping, at positions that correspond to the top faces of the partitions 5. The adhesion-improving layers 9 improve adhesion between the nozzle sheet 8 and the top faces of the partitions 5 on the substrate 3. The adhesion-improving layers 9 enhance adhesive strength to the top faces if the partitions 5 are composed of a semicured resin or ensure adhesion of the nickel nozzle sheet 8 to the top faces if the partitions 5 have no adhesive strength to the nickel nozzle sheet 8.

Accordingly, the adhesion-improving layers 9 preliminarily formed on the nozzle sheet 8 ensure satisfactory adhesion between the nozzle sheet 8 and the top faces of the partitions 5. The adhesion-improving layers 9 are composed of a material that exhibits satisfactory adhesion to both the nozzle sheet 8 and the top faces of the partitions 5 and that exhibits high mechanical strength durable for secondary bonding between the nozzle sheet 8 and the partitions 5.

In this embodiment, the adhesion-improving layers 9 are bonded to the nozzle sheet 8 by electrodeposition in the step of forming the nozzle sheet 8. An example of materials for forming the adhesion-improving layers 9 are an acrylic cationic electrodeposition coating "ELECOAT CS-2" made by Shimizu Co., Ltd.

Figure 2E:
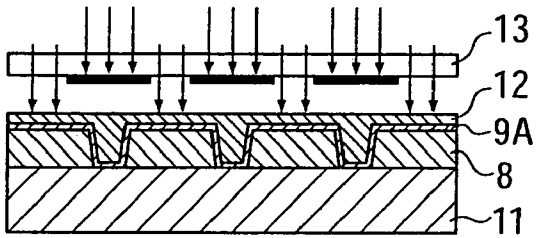
FIGS. 2A to 2H are cross-sectional views illustrating the steps of making the printer head shown in FIG. 1.
Figure 2F:
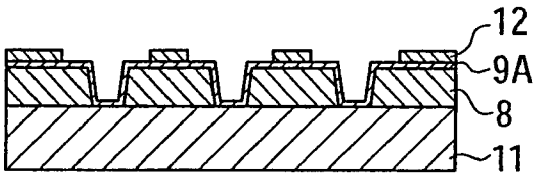
Figure 2G:
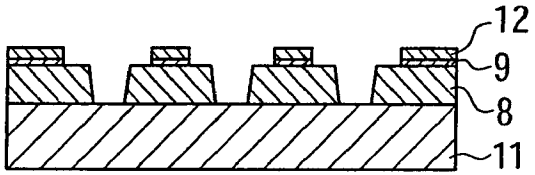
Figure 2H:
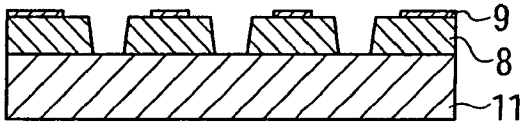
Figure 2A:
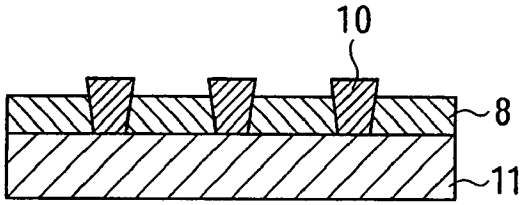

FIGS. 2A to 2H are cross-sectional views illustrating the steps of making the nozzle sheet unit 7. Referring to FIG. 2A, nonconductive projections 10 are formed on a flat master block 11 by photolithography. The shape of these projections 10 corresponds to that of nozzles. Then the nozzle sheet 8 is formed on the master block 11 by electrotyping using the master block 11 as an electrode. Preferably, the master block 11 is composed of a conductive material that is readily releasable from the nozzle sheet 8.

Figure 2B:
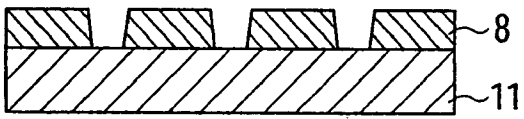

Referring to FIG. 2B, the photoresist projections 10 are removed. The nozzle sheet 8 having many dents thereby remains on the master block 11.

Figure 2C:
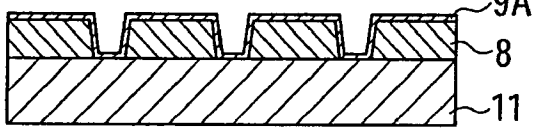
Figure 2D:
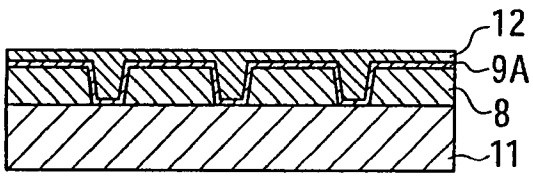

Referring now to FIG. 2C, a film 9A for forming the adhesion-improving layers 9 are provided by electrodeposition using the master block 11 as an electrode. Referring to FIG. 2D, a negative resist 12 is applied onto the surface by spin coating and is prebaked. Referring to FIG. 2E, the resist 12 is exposed through a photomask 13 that masks the resist 12 other than bare regions corresponding to the top faces of the partitions.

Referring to FIG. 2F, the unexposed portions of the resist 12 are removed by development. Referring to FIG. 2G, the film 9A in the bare regions is selectively removed through the resist 12 as a mask. The resulting nozzle sheet 8 provided with the adhesion-improving layers 9 corresponds to the nozzle sheet unit 7.

Next, the nozzle sheet unit 7 on the master block 11 is put into contact with the substrate 3, and these are heated to a predetermined temperature under a pressure to cure the partitions 5 completely and to bond the adhesion-improving layers 9 with the partitions 5. Then, the master block 11 is removed.

(1-2) Operation of First Embodiment

Referring to FIG. 1, this printer head 1 has the partitions 5 of the liquid chambers 4 and the partitions of the liquid channels on the semiconductor substrate 3 including driving devices and the like, and these partitions are composed of the semicured epoxyacrylate resin. Furthermore, the adhesion-improving layers 9 are provided at positions corresponding to the partitions of the nozzle sheet 8, and the nozzle sheet 8 is bonded to the partitions 5 of the liquid chambers 4 and the partitions of the liquid channels with the adhesion-improving layers 9 provided therebetween.

If the nozzle sheet 8 is composed of nickel having poor bonding strength to resin, the adhesion-improving layers 9 ensure high bonding strength between the nozzle sheet 8 and the resin. When a suitable substance is selected for the adhesion-improving layers 9, high bonding strength is ensured between the adhesion-improving layers 9 and the top faces of the partitions 5 that are composed of the semicured resin not having a large amount of reactive groups, regardless of secondary bonding. In this printer head 1, the nozzle sheet 8 is tightly bonded to the substrate 3 provided with the partitions of the liquid chambers 4 and the liquid channels.

Since the adhesion-improving layers 9 are preliminarily formed by electrodeposition on the nozzle sheet 8 under high-precision control of the thickness of the adhesion-improving layers 9 in a step of forming the nozzle sheet 8, the adhesion-improving layers 9 are tightly bonded to the nozzle sheet 8 composed of nickel having poor bonding strength to resin.

Since the adhesion-improving layers 9 at unnecessary portions, namely, the interiors of the nozzles 2 are removed by photolithography, the nozzles 2 can be formed at high precision, regardless of the formation of the adhesion-improving layers 9. Thus, the adhesion-improving layers 9 do not deteriorate the printing quality.

(1-3) Effects of First Embodiment

According to the structure of the first embodiment, the adhesion-improving layers provided on the nozzle sheet are tightly bonded to the top faces of the partitions with high bonding strength.

Furthermore, the adhesion-improving layers having a high-precision thickness can be formed by electrodeposition on the nozzle sheet during a step of forming the nozzle sheet.

(2) Second Embodiment

In the second embodiment, a photosensitive layer is disposed on a nozzle sheet by electrodeposition to form adhesion-improving layers by a simpler method compared with the first embodiment. The step of forming a nozzle sheet unit 7 in the second embodiment differs from that in the first embodiment, but other steps are identical to those in the first embodiment. An exemplary material for the photosensitive layer is a negative electrodeposition resist "SONNE EDUV376" made by Kansai Paint Co., Ltd.

Figure 3A:
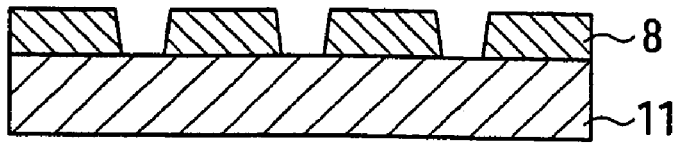
FIGS. 3A to 3D are cross-sectional views illustrating the steps of making a printer head according to a second embodiment of the present invention.
Figure 3B:
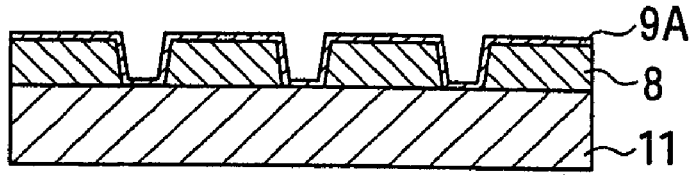
Figure 3C:
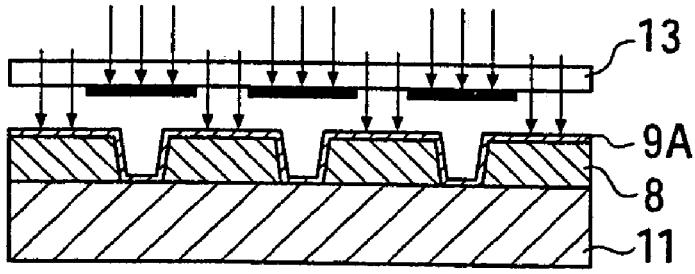
Figure 3D:
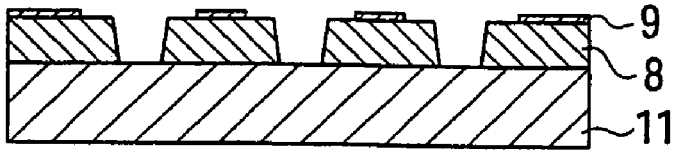

Referring to FIG. 3A, a nozzle sheet 8 is formed on a master block 11 by electrotyping as in the first embodiment. Referring to FIG. 3B, a film 9A for forming adhesion-improving layers 9 is formed thereon by electrodeposition using a photosensitive electrodeposition material. Referring to FIG. 3C, the film 9A is exposed through a photomask 13 and is developed to remove unnecessary portions of the film 9A. As shown in FIG. 3D, the adhesion-improving layers 9 are thereby formed on the nozzle sheet 8.

In this embodiment, as described above, the photosensitive film for forming the adhesion-improving layer is provided on the nozzle sheet and the adhesion-improving layers are selectively formed at the top faces of the partitions by patterning of the photosensitive film. Thus, in the second embodiment, a printer head can be produced by a more simplified step compared with the first embodiment.

(3) Third Embodiment

In the third embodiment, adhesion-improving layers are more effectively provided on the nozzle sheet by utilizing the step of forming the nozzle sheet. The third embodiment differs from the first embodiment in that a nozzle sheet unit 7 is prepared by another process, as follows.

Figure 4A:
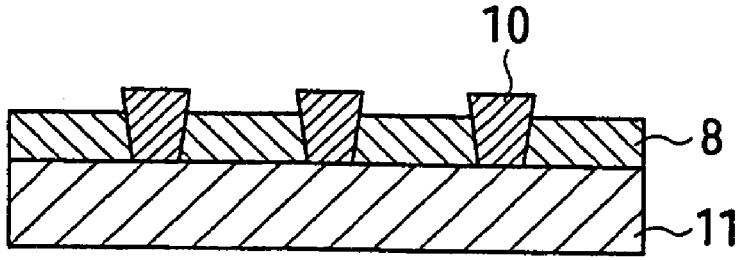
FIGS. 4A to 4C are cross-sectional views illustrating the steps of making a printer head according to a third embodiment of the present invention.
Figure 4B:
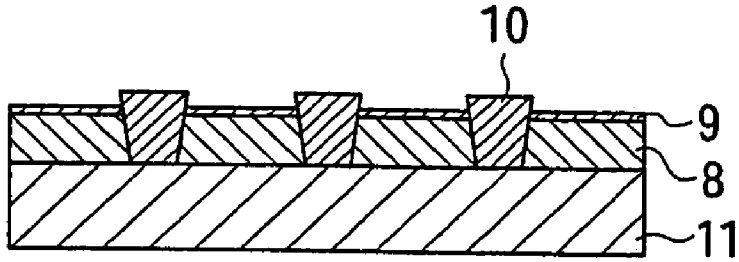
Figure 4C:
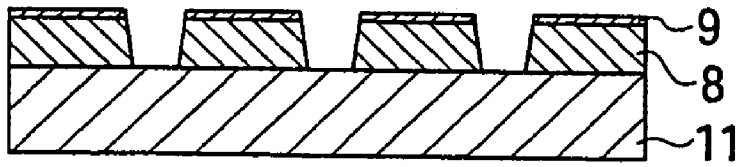

Referring to FIG. 4A, nonconductive projections 10 are provided on a master block 11 and the nozzle sheet 8 is formed on the master block 11 by electrodeposition. Referring to FIG. 4B, a film for adhesion-improving layers 9 are formed on the nozzle sheet 8 without removal of the projections 10 by electrodeposition. Referring to FIG. 4C, the projections 10 are removed.

According to this process, the adhesion-improving layers 9 are selectively formed by electrodeposition at the top faces of the partitions. In other words, the projections 10 function as masks for forming the adhesion-improving layers 9. As a result, the adhesion-improving layers 9 are formed by reduced production steps in the third embodiment.

(4) Fourth Embodiment

Figure 5A:
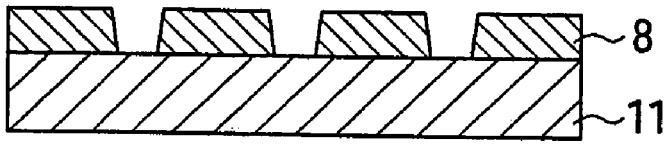
FIGS. 5A and 5B are cross-sectional views illustrating the steps of making a printer head according to a fourth embodiment of the present invention.
Figure 5B:
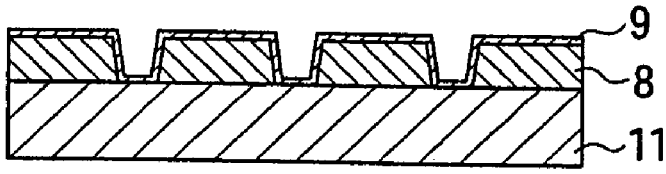

In the fourth embodiment, adhesion-improving layers are formed by deposition of diamond like carbon (DLC). Referring to FIG. 5A, a nickel nozzle sheet 8 is formed on a master block 11 as in the first embodiment. Referring to FIG. 5B, the DLC is deposited thereon by a dry process such as a sputtering process or a CVD process. The DLC layers function as the adhesion-improving layers 9.

It is empirically known that the DLC layer has high bonding strength to the semicured resin and the nickel nozzle sheet 8, even if the DLC layer has a smaller thickness. The DLC layer having a small thickness inside the nozzles does not preclude discharge of the ink.

In this embodiment, the nozzle sheet unit 7 is put into close contact with the top faces of the partitions 5 provided with the adhesion-improving layers 9. Next, the master block 11 is removed to expose the nozzle 2. The DLC adhesion-improving layer also has the same advantages as those in the first embodiment.

(5) Fifth Embodiment

The fifth embodiment is a modification of the fourth embodiment. In this embodiment, ions are preliminarily implanted into the nozzle sheet prior to the formation of the DLC adhesion-improving layer. For example, carbon ions are implanted into the nozzle sheet by plasma ion implantation, as a preliminary treatment, and then the DLC is deposited on the nozzle sheet to form the adhesion-improving layers 9. As a result, the adhesion-improving layers 9 adhere to the nozzle sheet 8 more securely by the anchor effect of the ion implantation.

(6) Sixth Embodiment

In the sixth embodiment, adhesion-improving layers 9 are formed on a nozzle sheet 8 using a polyimide block copolymer, which is different from known photosensitive polyimide. A process for preparing such a polyimide block copolymer is disclosed in U.S. Pat. No. 5,502,143. In this process, the polyimide is directly synthesized, not from polyamic acid as a precursor of the polyimide. Polyimide blocks are coupled with each other to form the block polyimide copolymer. This method has large flexibility of material designing for synthesis of polyimide having desired adhesiveness by controlling characteristics of the blocks, which are the minimum unit in this copolymer.

Such a polyimide block copolymer is applied onto the nozzle sheet to form the adhesion-improving layers. Examples of polyimide block copolymers are adhesive polyimide containing bicyclo[2,2,2]oct-7-en-2,3,5,6-tetracarboxylic dianhydride and/or 3,5-diaminobenzoic acid.

Figure 6A:
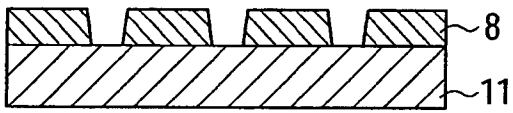
FIGS. 6A to 6G are cross-sectional views illustrating the steps of making a printer head according to a fifth embodiment of the present invention.
Figure 6B:
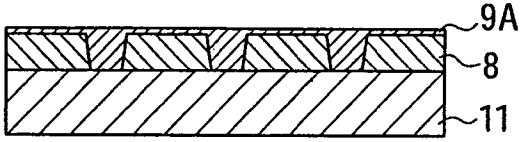
Figure 6C:
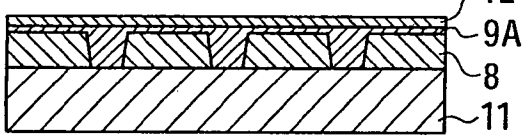
Figure 6D:
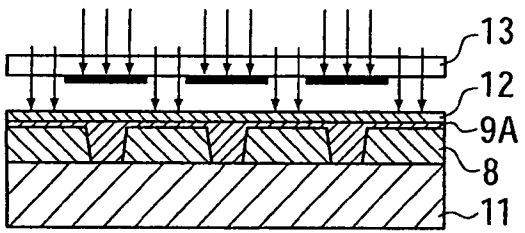

Referring to FIG. 6A, a nozzle sheet 8 is formed on a master block 11, as in the first embodiment. Referring to FIG. 6B, a polyimide block copolymer coating is applied over the nozzle sheet 8 and the master block 11 by spin coating, screen printing, dipping, or roll coating. The coating is subjected to heat treatment such as prebaking to form a film 9A for adhesion-improving layers. Referring to FIG. 6C, a negative photoresist 12 is applied to the surface and is prebaked as in the copolymer coating. Referring to FIG. 6D, the photoresist 12 is exposed through a photomask 13 at regions other than the top faces of the partitions.

Figure 6E:
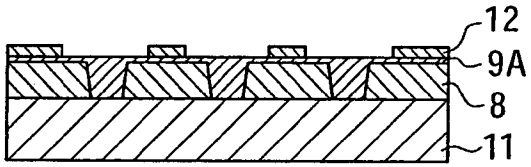
Figure 6F:
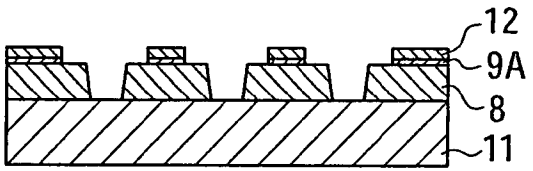
Figure 6G:
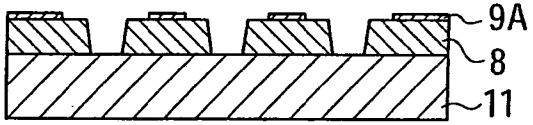

Referring to FIG. 6E, the unnecessary regions of the photoresist 12 are removed by development. Referring to FIG. 6F, the film 9A inside the nozzles is selectively etched through the photoresist 12 functioning as a mask. Referring to FIG. 6G, the photoresist 12 is removed to complete the nozzle sheet unit 7 (the nozzle sheet 8 provided with the adhesion-improving layers 9).

Since the polyimide block copolymer is photosensitive, the forming and patterning of the photoresist 12 are not required. Instead, the film 9A is directly exposed and developed. The adhesion-improving layers 9 composed of the polyimide block copolymer are thereby formed at the top faces of the partitions. Accordingly, the use of the photosensitive polyimide block copolymer enables the omission of the coating step of the photoresist 12.

The adhesion-improving layers 9 of the polyimide block copolymer also have the same advantages as those in the first embodiment.

(7) Seventh Embodiment

In the seventh embodiment, adhesion-improving layers are formed by strike plating on a surface of a nozzle sheet. In general, a nickel or nickel alloy nozzle sheet formed by electrotyping exhibits poor adhesiveness to other materials, compared to the adhesiveness of pure nickel metal or alloys to the materials. In particular, a bright plated surface formed using a brightener shows significantly poor adhesiveness.

A strike-plated surface layer improves the adhesiveness of the nickel nozzle sheet. Herein, "strike plating" is a preliminarily treatment for improving adhesiveness between a substrate and a plated surface. For example, the strike plating can form a plated layer having high adhesiveness on a passivation surface of a stainless steel substrate. Furthermore, the strike plating can remove the passivation film to activate the surface. The strike plating is also applicable to preliminary treatment for plating another nickel layer on a nickel bright-plated layer.

In this embodiment, nickel strike-plated layers with a thickness of about 0.2 μm were formed on the bright-plated layers of the nozzle sheet in a nickel chloride bath. Active layers having high adhesiveness are thereby formed on the bright-plated layers. Accordingly, high adhesion is achieved between the nozzle sheet and the top faces of the partitions.

(8) Eighth Embodiment

In the eighth embodiment, strike-plated layers are formed on a surface of a nozzle sheet as in the seventh embodiment, and then adhesion-improving layers according to any one of the above embodiments are formed on the strike-plated layers. This double-layer structure of the strike-plated layers and the adhesion-improving layer ensures higher adhesion of the nozzle sheet.

(9) Ninth Embodiment

In the ninth embodiment, strike-plated layers are formed on a surface of a nozzle sheet as in the seventh embodiment, and then dull nickel-plated layers are formed on the strike-plated layers. This double-layer structure of the strike-plated layer and the nickel dull-plated layer ensures higher adhesion of the nozzle sheet, since the upper nickel dull-plated layer has a surface having fine unevenness that improves adhesiveness. Furthermore, the strike-plated layers ensure adhesion to both the nickel bright-plated layers and the nickel dull-plated layers.

(10) Tenth Embodiment

In the tenth embodiment, strike-plated layers are formed on a surface of a nozzle sheet as in the seventh embodiment, nickel dull-plated layers are formed on the strike-plated layers, and then adhesion-improving layers according to one of the above embodiments are formed on the nickel dull-plated layers. This triple-layer structure further improves adhesion of the nozzle sheet.

(11) Eleventh Embodiment

In the eleventh embodiment, adhesion-improving layers and partitions are composed of the same material. In regard to other matters, any of the above embodiments or any other technology is also applicable to this embodiment.

Even if the material for the adhesion-improving layers and the partitions is semicured, these are tightly bonded to each other during a curing process, by an intermixing effect at the adhesive interface, regardless of secondary bonding. Examples of the semicured materials are epoxy resins, polyimide resins, and acrylic resins. Since the adhesion-improving layer before semicuring contains a large amount of reactive groups, it is tightly bonded to the nozzle sheet during the curing process.

(12) Other Embodiments

In the above embodiments, the adhesion-improving layers are formed by photolithography. In the present invention, however, the adhesion-improving layers may be formed by any other method. Examples of such methods include printing processes, i.e., screen printing and intaglio printing, and droplet discharging processes using liquid discharge apparatuses, such as the liquid discharge apparatus according to the present invention.

In the above embodiments, the adhesion-improving layers are formed on the nickel nozzle sheet produced by electrotyping. In the present invention, however, the adhesion-improving layers may be formed on a nozzle sheet composed of any material such as polyimide and produced by any process.

In the above embodiments, the heating element is used as the driving element. In the present invention, however, a piezoelectric element may be used as the driving element.

In the above embodiments, the driving element and the drive circuit are integrated in the substrate. In the present invention, however, only the driving element may be formed in the substrate.

In the above embodiments, the liquid discharge apparatus of the present invention is applied to a printer head of a printer for discharging ink droplets. Furthermore, the liquid discharge apparatus is applicable to printer heads that discharges dye droplets and droplets for protective films, microdispensers for discharging chemical reagents, various analytical or testing instruments, and various patterning apparatuses that discharge chemical reagents for protecting elements from etching.

As described above, the adhesion-improving layers provided on the nozzle sheet ensure high bonding strength to the top faces of the partitions.

What is claimed is:

1. A liquid discharge apparatus having liquid chambers and nozzles that discharge droplets of liquid contained in the liquid chambers, the liquid discharge apparatus comprising:

a substrate provided with partitions over one face thereof, the liquid chambers being disposed between the partitions;

a nozzle sheet provided with an adhesion-improving layer at least at positions corresponding to the top faces of the partitions and provided with the nozzles for discharging liquid, the nozzle sheet and the top faces of the respective partitions being bonded to each other with the adhesion-improving layer therebetween; and driving elements provided over the face of the substrate at positions corresponding to the liquid chambers for changing the pressure of the liquid chambers, and wherein the adhesion-improving layer and the partitions are comprised of the same material.

2. A printer head having liquid chambers and nozzles that discharge droplets of liquids contained in the liquid chambers, the printer head comprising:

a substrate provided with partitions over one face thereof, the liquid chambers being disposed between the partitions;

a nozzle sheet provided with an adhesion-improving layer at positions corresponding to the top faces of the partitions and provided with the nozzles for discharging liquid, the nozzle sheet and the top faces of the respective partitions being bonded to each other with the adhesion-improving layer therebetween; and driving elements provided over the face of the substrate at positions corresponding to the liquid chambers, for changing the pressure of the liquid chambers; and wherein the adhesion-improving layer and the partitions are comprised of the same material.

3. A method for making a liquid discharge apparatus for discharging droplets of liquid from liquid chambers by means of a change in pressure of the liquid chambers using respective driving elements, the method comprising the steps of:

forming partitions that form liquid chambers on a substrate having driving elements; and then placing a nozzle sheet having nozzles and an adhesion-improving layer on the top of the partitions, the adhesion-improving layer being provided at least at positions corresponding to the top faces for improving adhesion with the top of the partitions, and wherein the adhesion-improving layer and the partitions are comprised of the same material.

* * * * *